US006769207B1

(12) United States Patent
Brown et al.

(10) Patent No.: US 6,769,207 B1
(45) Date of Patent: Aug. 3, 2004

(54) PORTABLE SIGN ASSEMBLY

(75) Inventors: Gregory H. Brown, Stow, OH (US); Charles M. Mettler, Perry, OH (US); David E. Cowan, Orange Village, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 98 days.

(21) Appl. No.: 10/060,719

(22) Filed: Jan. 30, 2002

(51) Int. Cl.[7] ..... G09F 15/00
(52) U.S. Cl. ..... 40/607.12; 40/607.14
(58) Field of Search ..... 40/607.12, 607.14; 404/9; 248/230.8, 220.22

(56) References Cited

U.S. PATENT DOCUMENTS

| | | | | |
|---|---|---|---|---|
| 3,922,805 A | * | 12/1975 | Krug | |
| 3,958,351 A | * | 5/1976 | Summey | |
| 4,197,808 A | | 4/1980 | Kinninger | |
| 4,548,377 A | * | 10/1985 | Huel | |
| 4,782,783 A | * | 11/1988 | Kulp et al. | 404/9 |
| 4,798,017 A | | 1/1989 | Giotis | 40/612 |
| 4,925,334 A | | 5/1990 | Beard | |
| 5,212,898 A | * | 5/1993 | Dinan et al. | |
| 5,599,132 A | | 2/1997 | Hughes, Jr. | |
| 5,673,889 A | * | 10/1997 | DeValcourt | 248/230.8 |
| 6,186,454 B1 | * | 2/2001 | Olsen | |
| 6,338,212 B1 | * | 1/2002 | Santa Cruz et al. | |

FOREIGN PATENT DOCUMENTS

| | | |
|---|---|---|
| GB | 2 182 701 A | 5/1987 |
| GB | 2 213 854 A | 8/1989 |
| GB | 2 270 332 A | 3/1994 |

* cited by examiner

*Primary Examiner*—Joanne Silbermann
(74) *Attorney, Agent, or Firm*—Renner, Otto, Boisselle & Sklar, LLP

(57) ABSTRACT

A portable sign assembly includes one or more sign supports attached to the outer surface of a flexible band that may be adjustable to fit different diameter drums. Each sign support may have a substantially planar front face to facilitate attachment of a panel assembly to the sign support. The panel assembly may comprise one or more sign panels. If there is more than one sign panel, a drop panel having a greater vertical height than the sign support may be attached to the sign support to provide a larger attachment area for the sign panels.

12 Claims, 2 Drawing Sheets

PORTABLE SIGN ASSEMBLY

FIELD OF THE INVENTION

This invention relates to a portable sign assembly that is removably attachable to a traffic channelizer drum to provide a directional barricade for redirecting traffic.

BACKGROUND OF THE INVENTION

It is generally known to provide portable signs that are adapted to be attached to a traffic cone or the like. However, there is a need for a relatively low cost portable sign assembly that is easily attachable to almost any traffic channelizer drum to provide a Type I or Type II barricade and is just as easily removable from the drum to allow a plurality of such drums to maintain their original stacking characteristics for ease of transportation and storage.

SUMMARY OF THE INVENTION

The portable sign assembly of the present invention is designed to be easily attachable to almost any traffic channelizer drum to transform almost any drum into an effective directional barricade, including drums that might otherwise be discarded because they no longer have their reflective sheeting. Utilizing these drums greatly reduces the cost of the directional barricades.

In accordance with one aspect of the invention, the portable sign assembly includes a sign support that is attachable to the top tier of almost any traffic channelizer drum by an adjustable band that may be adapted to fit different diameter drums.

In accordance with another aspect of the invention, the sign support may have a substantially planar front face to facilitate attachment of a panel assembly to the sign support.

In accordance with another aspect of the invention, the panel assembly may comprise one or more sign panels used to direct traffic. If the panel assembly only includes one sign panel (for providing a Type I barricade), the sign panel may be attached directly to the front face of the sign support. If the sign assembly includes two or more sign panels (for providing a Type II barricade), a drop panel having a greater vertical height than the sign support may be attached to the front face of the sign support to provide a larger attachment surface for two or more sign panels.

In accordance with another aspect of the invention, the portable sign assembly may include more than one sign support and associated panel assembly to provide a bidirectional barricade when mounted on a traffic channelizer drum.

In accordance with another aspect of the invention, the portable sign assembly may easily be removed from a traffic channelizer drum to allow a plurality of the drums to be stacked in conventional manner for ease of transportation and storage.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
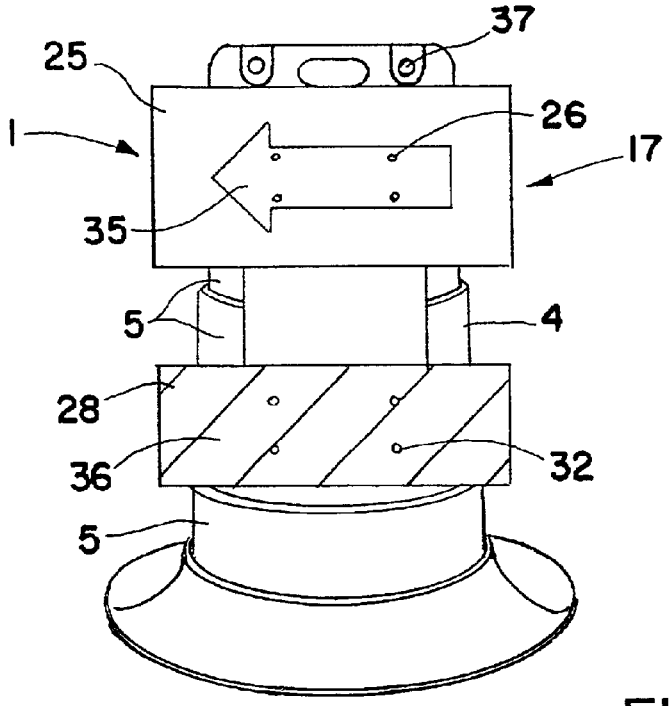
FIG. 1 is a front elevation view of one form of portable sign assembly of the present invention shown attached to a traffic channelizer drum to form a Type II traffic barricade.
Figure 2:
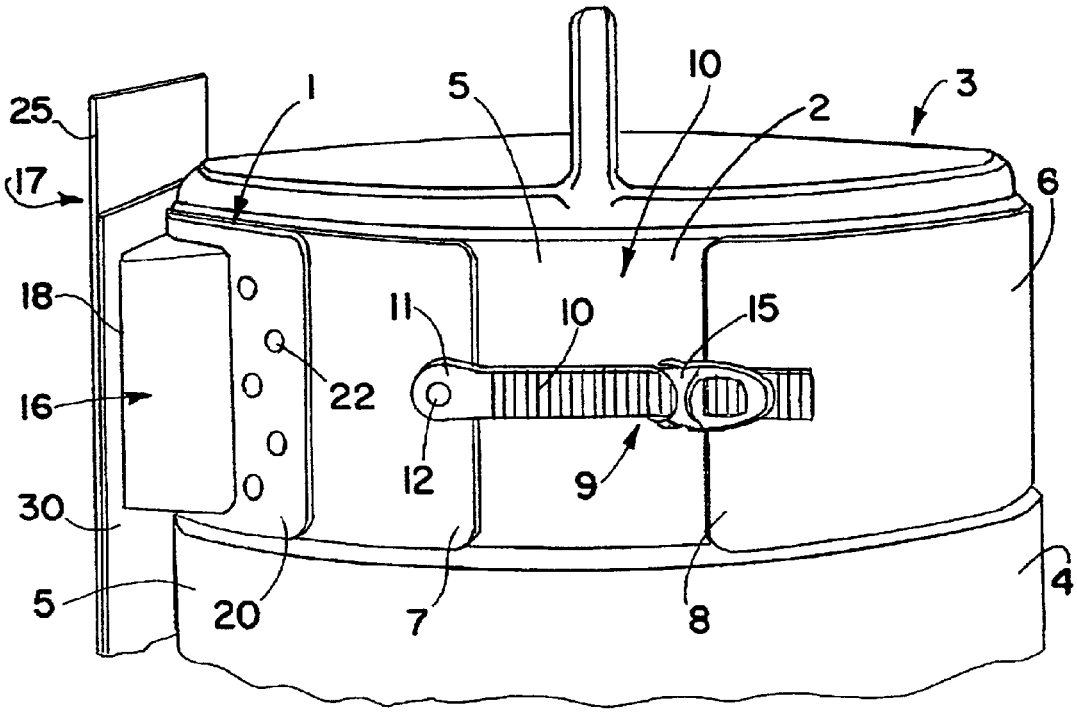
FIG. 2 is an enlarged fragmentary side elevation view of the portable sign assembly and traffic channelizer drum of FIG. 1, showing how the portable sign assembly is releasably attachable to the top tier of the drum.

Referring now in detail to the drawings, and initially to FIGS. 1 and 2, there is shown one form of portable sign assembly 1 of the present invention attached to the top tier 2 of a traffic channelizer drum 3 to provide a directional barricade for redirecting traffic and the like. Drums of almost any type may be used for this purpose, as may drums that might otherwise be discarded because they no longer have their reflective sheeting. Utilizing these latter drums greatly reduces the cost of the directional barricades.

The drum 3 itself is hollow and is typically made of a relatively lightweight plastic material which will not cause damage to a vehicle if the vehicle should accidentally strike the drum. Because these drums are relatively light in weight, some type of internal and/or external ballast is needed to prevent the drums from being inadvertently blown over or moved about by the wind and/or air blasts caused by passing vehicles.

The side wall 4 of the drums may either be generally cylindrical in shape or of a generally oval shape. In either case, the drums are typically stepped radially inwardly at discrete intervals along their axial length from bottom to the top to facilitate stacking of the drums for easy handling and storage and to provide a plurality of axially spaced surfaces 5 which are typically recessed to protect reflective sheeting applied to one or more of the surfaces against damage during stacking. One such drum is shown in U.S. Pat. No. 5,234,280 assigned to the same assignee as the present application. The entire disclosure of U.S. Pat. No. 5,234,280 is incorporated herein by reference.

Figure 3:
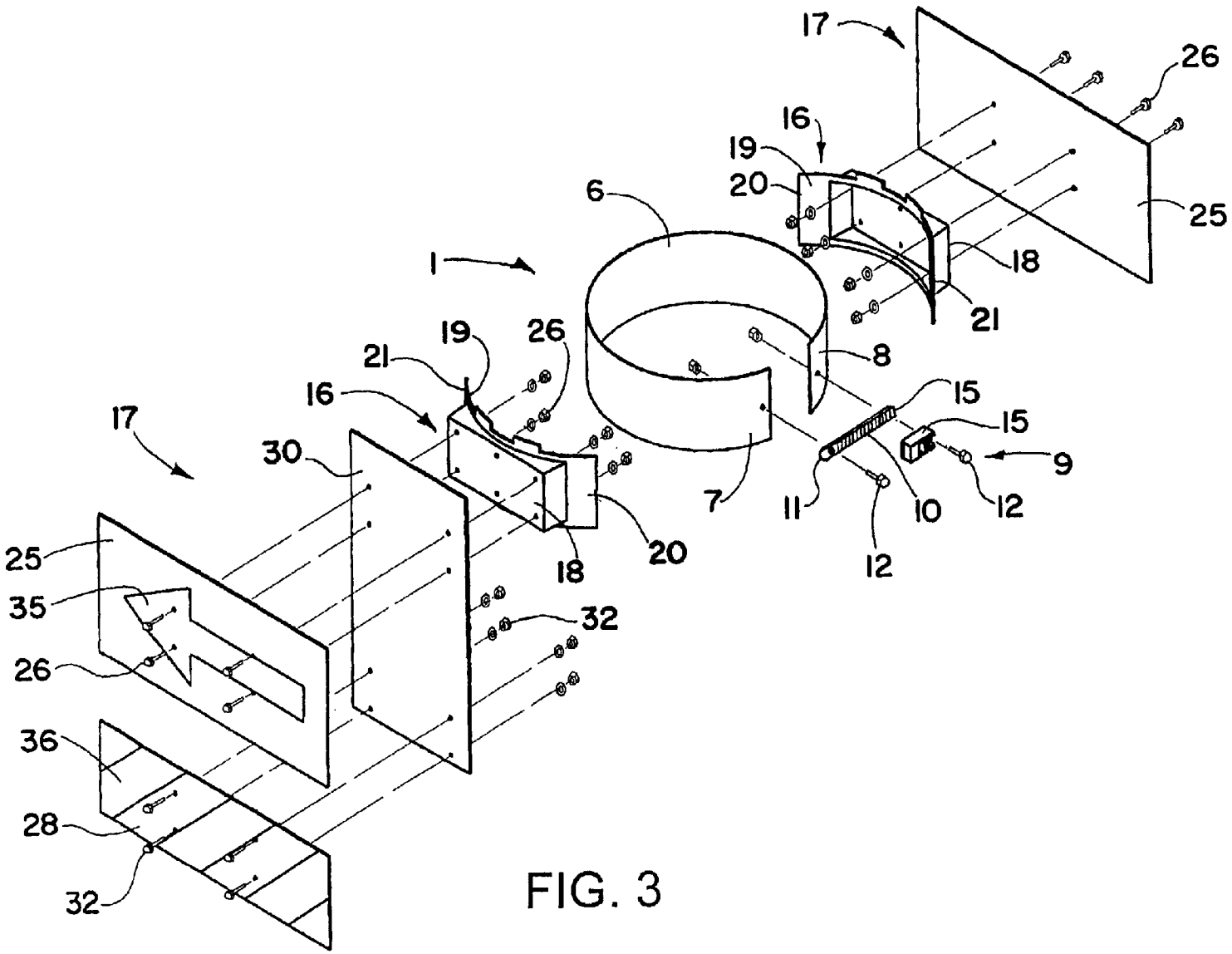
FIG. 3 is an exploded isometric view of the portable sign assembly of the present invention which may include more than one sign support and associated panel assembly to provide a bidirectional barricade when mounted on a drum.

The portable sign assembly 1 of the present invention is removably attachable to the drum 3 as by means of a flexible band 6, preferably made of plastic. As shown in FIGS. 2 and 3, the band 6 may have opposite ends 7, 8 connectable together by a suitable locking mechanism 9 that is adjustable to lengthen or shorten the spacing between the ends of the band to allow the band to fit different diameter drums. In the embodiment disclosed herein, the locking mechanism 9 may comprise a strap 10 having one end 11 attached to one end of the band 6 by a suitable fastener 12 and a buckle 15, which may be of the ratchet or toggle type, attached to the other end of the band also by a suitable fastener 12. The free end of the strap 10 may be inserted through the buckle 15 and either pulled or loosened as desired to change the overall diameter of the band to fit different diameter drums or to release the band from the drum.

Mounted on the outer surface of the band 6 preferably approximately 90° from the locking mechanism 9 is a sign support 16 used to attach a panel assembly 17 to the band. Sign support 16 may be molded as a single piece out of a suitable plastic such as high density polyethylene, and has a substantially planar front face 18 (see FIG. 3) to facilitate attachment of the panel assembly 17 to the sign support as described hereafter. The rear face 19 of the sign support 16 may be radiused to substantially match the radius of curvature of the top tier of a drum to which the portable sign assembly 1 is adapted to be attached.

Sign support 16 has curved ends that may protrude beyond opposite ends of the planar front face 18 of the sign support to provide mounting surfaces 20, 21 for attaching the sign support to the band 6 using suitable fasteners such as rivets 22 extending through the mounting surfaces and band (see FIG. 2).

If desired, two sign supports 16 and associated panel assemblies 17 may be mounted on the outer surface of the band 6 spaced approximately 180° from each other as schematically shown in FIG. 3 to provide a bidirectional barricade when mounted on a drum for use in a two lane, two-way application. Also, each sign assembly 17 may comprise one or more sign panels depending on the type of traffic barrier desired. For example, the panel assembly 17 may only have one sign panel 25 (for providing a Type I barricade). In that event the sign panel 25 may be attached directly to the planar front face 18 of the sign support 16 by suitable fasteners 26 such as nuts and bolts, screws or rivets extending through both parts as schematically shown at the right side of FIG. 3.

Alternatively the panel assembly 17 may include two or more sign panels 25 and 28 (for providing a Type II barricade) as shown in FIG. 1 and at the left side of FIG. 3. In that event, a drop panel 30 having a greater vertical height than the sign support 16 may be attached to the front face 18 of the sign support 16 to provide a larger attachment surface for attaching two or more sign panels 25 and 28 thereto. One of the sign panels 25 may be attached to the drop panels 30 by one set of fasteners 26 extending through the sign panel and the drop panel as well as the planar front face 18 of the sign support 16, whereas the other sign panel 28 may be attached to the drop panel 30 by another set of fasteners 32 extending through the other sign panel and drop panel in vertical spaced relation below the one sign panel and sign support as schematically shown in FIGS. 1 and 3.

The top of the sign panel 25 may extend above the top of both the sign support 16 and the drop panel 30 as further shown in FIG. 2. Sign panels 25 and 28 may have conventional markings on their respective front faces for carrying directional information. For example, one sign panel 25 may have reflective sheeting in the shape of an arrow 35 and the other sign panel 28 may have reflective sheeting in the shape of stripes 36 or the like as schematically shown in FIGS. 1 and 3.

From the foregoing, it will be apparent that the portable sign assembly of the present invention provides an economical, durable and extremely effective way of quickly transforming a traffic channelizer drum or the like into a directional (or bidirectional) barricade. Also, the barricade can be used with a warning light simply by attaching the warning light to the mounting hole 37 (FIG. 1) of whichever drum is being used.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A portable sign assembly comprising a band adapted to fit different diameter traffic channelizer drums, a sign support attached to an outer surface of said band, and a panel assembly attached to said sign support, said sign support having a substantially planar front face to which said panel assembly is attached, and a radiused inner face substantially corresponding to the radius of curvature of a drum to which said sign assembly is adapted to be attached, and curved ends that extend beyond opposite ends of said planar front face, said curved ends having fasteners extending therethrough and through said band for attaching said sign support to said band.

2. The sign assembly of claim 1 wherein additional fasteners extend through said panel assembly and said planar front face of said sign support for attaching said panel assembly to said sign support.

3. The sign assembly of claim 1 wherein said band has opposite ends connectable together by a locking mechanism that is adjustable to lengthen or shorten the spacing between said ends.

4. The sign assembly of claim 3 wherein said locking mechanism comprises a strap attached to one of said band ends and a buckle attached to the other of said band ends for receiving said strap.

5. The sign assembly of claim 4 wherein said buckle is a ratcheting buckle.

6. The sign assembly of claim 1 wherein two sign supports each having respective panel assemblies mounted thereon are attached to the outer surface of said band in circumferentially spaced relation from one another to provide a bi-directional barricade when fitted on a traffic delineator drum.

7. The sign assembly of claim 1 wherein said panel assembly comprises a drop panel attached to said sign support, said drop panel having a vertical height greater than the vertical height of said sign support, fasteners extending through one sign panel and said drop panel and said sign support for attaching said one sign panel and said drop panel to said sign support, and additional fasteners extending through another sign panel and said drop panel in vertically spaced relation from said one sign panel for attaching said another sign panel to said drop panel.

8. The sign assembly of claim 7 wherein said one sign panel extends above a top of both said sign support and said drop panel.

9. The sign assembly of claim 7 wherein two sign supports each having respective panel assemblies mounted thereon are attached to the outer surface of said band in circumferentially spaced relation from one another to provide a bi-directional barricade when fitted on a traffic delineator drum.

10. A directional traffic barricade comprising a traffic channelizer drum and a portable sign assembly removably attachable to said drum, said sign assembly comprising a band adapted to fit different diameter drums, a sign support attached to said band, and a panel assembly attached to said sign support, said sign support having a radiused inner face substantially corresponding to the radius of curvature of said drum, a substantially planar front face to which said sign assembly is attached, and curved ends that extend beyond opposite ends of said planar front face, said curved ends having fasteners extending therethrough and through said band for attaching said sign support to said band.

11. The barricade of claim 10 wherein said panel assembly comprises a drop panel attached to said sign support, said drop panel having a vertical height greater than the vertical height of said sign support, fasteners extending through one sign panel and said drop panel and said sign support for attaching said one sign panel and said drop panel to said sign support, and additional fasteners extending through another sign panel and said drop panel in vertically spaced relation from said one sign panel for attaching said another sign panel to said drop panel.

12. The barricade of claim 11 wherein said one sign panel extends above a top of both said sign support and said drop panel.

* * * * *